US007716750B2

(12) United States Patent
Sato

(10) Patent No.: US 7,716,750 B2
(45) Date of Patent: May 18, 2010

(54) NECKTIE

(76) Inventor: Norikazu Sato, 2-46-8, Unoki, Ohta-ku, Tokyo (JP) 1460091

( * ) Notice: Subject to any disclaimer, the term of this patent is extended or adjusted under 35 U.S.C. 154(b) by 0 days.

(21) Appl. No.: 11/365,704

(22) Filed: Mar. 1, 2006

(65) Prior Publication Data

US 2006/0143781 A1 Jul. 6, 2006

(51) Int. Cl.
*A41D 25/08* (2006.01)

(52) U.S. Cl. ..... 2/152.1

(58) Field of Classification Search ..... 2/144–151, 2/152.1, 153–157; 24/49.1, 54, 65, 66.1
See application file for complete search history.

(56) References Cited

U.S. PATENT DOCUMENTS 407,811 A * 7/1889 Bruce ..... 2/150
1,588,609 A * 6/1926 Palmer ..... 2/145
2,470,973 A * 5/1949 Bovee ..... 2/137
2,508,472 A * 5/1950 Scully ..... 2/145
4,958,383 A * 9/1990 Thompson ..... 2/150
5,253,366 A * 10/1993 Marlo et al. ..... 2/145
5,432,953 A * 7/1995 Kim ..... 2/148
7,096,509 B2 * 8/2006 Kim ..... 2/145

* cited by examiner

*Primary Examiner*—Tejash Patel
(74) *Attorney, Agent, or Firm*—Donald E. Schreiber

(57) ABSTRACT

A necktie is preformed with a knot or knot like section which is adapted to be attached to the collar of a shirt by a fastening means that can be separated from the necktie body and can be attached to the shirt collar to cause the necktie to be suspended. Such an entirely new type of necktie can be used by one irrespective of age and sex.

Use of the fastening means makes fitting easy and makes nil the sense of oppression around the neck area. Only a minor change made to an ordinary necktie allows this new necktie to be manufactured inexpensively and to be washed while retaining its shape. A necktie is thus provided that can be returned easily to the state of an ordinary necktie and that is not different in appearance from an ordinary necktie.

9 Claims, 22 Drawing Sheets

NECKTIE

TECHNICAL FIELD

The present invention relates to providing a necktie, shirt and button and napkin which utilize a fastening means to give rise to a variety of advantages such as that it can easily be worn or fitted and that there is no sense whatever of oppression around the neck area fitted with it.

BACKGROUND ART

A necktie as a male's accessory that displays an expression of such as its wearer's taste, character, social status or emotion is an extremely important ware that has been used since the early nineteenth century. However, fitting or tying a necktie is hard if it is inexperienced. In addition, oppression around the neck area during its fitting restrains emission of the body heat and at the same time detriments flow of the blood, causing some to get the stiffness in the shoulders, and its improvements have thus come to be desired. Also, the knot in the conventional necktie when tied and its wider flap section beneath the knot are discontinuous in pattern and design, marring its appearance.

Accordingly, in order to facilitate fitting there has hitherto been proposed a necktie 1 as shown in FIG. 1 as Example 1 which is preformed with a knot 2 having a shape into which it is tied. A string 3 is passed through the knot 2 in the form of a circle and is hung around the neck and its one end 3*a* is pulled to tighten the circle. However, this prior art does not eliminate oppression around the neck area in fitting either and, if the end 3*a* of the string 3 is pulled intensively, even a suffocation may be brought about. Also, with a narrower flap section of the necktie tied in a layer on the collar of a shirt, the body heat is hard to escape so that it is stifling especially in the summer season. There are further the shortcomings that having a specialized maker form the knot 2 raises the manufacturing cost and that the knot 2 soiled most easily with sweat tends to absorb much water when washed and then is hard to dry and tends to lose its shape.

There has also been proposed a necktie 1 as shown in FIG. 2 as Example 2 which to facilitate its fitting is preformed with a knot 2 having a shape into which it is tied, the knot 2 including a nipping hook (snap fitting) 4 that is nipped on the collar of a shirt to fasten the knot thereto. While this prior art is designed to eliminate the oppression around the neck area during fitting, the first button of a shirt need necessarily be then fastened and, thought it is simple to fit, considerable force is required to detach. Further, direct contact of a hook section of the nipping hook 4 with the skin easily brings bout an allergic reaction. Here again, there are further the weak points that having a specialized maker form the knot 2 raises the manufacturing cost and that the knot 2 soiled most easily with sweat tends to absorb much water when washed and then is hard to dry and tends to lose its shape.

Furthermore, both the neckties mentioned above which have been machined into the shape in which they are tied cannot be returned to the state of a normal necktie. Also, with the knot made in a complicated way of tying, the problem of pattern discontinuity has been met in both types of neckties, impairing their appearances.

[Patent Literature 1] JP P 2002-317321 A

[Patent Literature 2] JP UM 3,012,134 A

DISCLOSURE OF THE INVENTION

It is accordingly an object of the present invention to provide a necktie which with the use of a fastening means has many advantages including those that it can be easily fitted and detached, it does not require the first button of a shirt to be fastened, it makes oppression around the neck area nil, it requires only a minor change to be made on an ordinary necktie to allow it to be manufactured inexpensively, it can be washed and can retain its shape if washed and it can be retuned easily to the state of an ordinary necktie.

In order to achieve the object mentioned above, there is provided in accordance with the present invention as set forth in claim 1 a necktie which comprises an uncut, unseparated, undrilled and otherwise unmachined tie body that is formed with a knot or knot like section, the knot or knot like section being adapted to be attached to the collar of a shirt by a fastening means to cause the tie body to be suspended.

According to this makeup in which the necktie is not wound around the neck, the necktie can be easily fitted and detached while making the oppression around the neck area nil.

There is provided in accordance with the present invention as set forth in claim 2 a necktie as set forth in claim 1, characterized in that the tie body is folded along a crease between a wider and a narrower flap section thereof so that the rear surfaces of the said sections face with each other, edges of the said narrower flap section in the vicinity of the crease are folded about a longitudinal center line to form a reduction of area there and then edges of the said wider flap section are folded to wrap the said reduction of area therewith in the vicinity of the said crease and secured together to form a constriction there, thereby forming the said knot like section between the said constriction and the said crease. This makeup provides a necktie that is not wound around the neck and that is without the knot (but with a knot like section).

There is provided in accordance with the present invention as set forth in claim 3 a necktie as set forth in claim 2, characterized in that the said reduction of area is formed by folding the said narrower flap section from its front side to its rear side or vise versa.

There is provided in accordance with the present invention as set forth in claim 4 a necktie as set forth any one of claims 1 to 3, characterized in that a shaping element is inserted in the said knot or knot like section. This shaping element allows the necktie to be neatly shaped.

There is provided in accordance with the present invention as set forth in claim 5 a necktie as set forth in any one of claims 1 to 4, characterized in that the said knot like and wider flap sections are continuous and have a pattern, design or ornament applied thereto on their surfaces. In an ordinary necktie, the knot and the wider flap section of the tie body beneath it are not continuous in surfaces and hence a pattern or the like cannot be shown continuously from the knot. However, this can be made possible in accordance with the present invention.

There is provided in accordance with the present invention as set forth in claim 6 a necktie as set forth in claim 4, characterized in that the tie body is tied around the said shaping element and the said fastening means to form the said knot section as in an ordinary necktie, the said knot section being adapted to be attached to the collar of the shirt. This makeup provides a necktie which though not wound around the neck, is not different in appearance from an ordinary necktie.

There is provided in accordance with the present invention as set forth in claim 7 a necktie as set forth in claim 1 or claim 4, characterized in that the tie body is tied in an ordinary manner to form a knot together with a neck encircling section which is then pulled into the said knot to form the said knot like section, the said knot like section being adapted to be attached to the collar of the said shirt by the said fastening means. A necktie is thus provided that like a necktie as set forth in claim 6 is not different in appearance from an ordinary necktie.

There is provided in accordance with the present invention as set forth in claim 8 a necktie as set forth in claim 7, characterized in that the said knot like section comprises the said normally tied knot and a part of the said neck encircling section above it.

There is provided in accordance with the present invention as set forth in claim 9 a necktie as set forth in claim 7 or claim 8, characterized in that in a region below the said knot like section of the tie body, edges of the said wider flap section are folded to wrap the said narrower flap section of the tie body therewith and then fastened together to form a further constriction below the said knot like section.

There is provided in accordance with the present invention as set forth in claim 10 a necktie as set forth in any one of claims 1 to 9, characterized in that the said fastening means is in the form of a band piece or strip passed through the said knot or knot like section, the said band piece having fastening sections at both ends thereof adapted to engage with fastening sections which are provided on the collar of the said shirt.

There is provided in accordance with the present invention as set forth in claim 11 a necktie as set forth any one of claims 1 to 10, characterized in that the said fastening means is in the form of a band piece having fastening sections at both ends thereof adapted to engage with fastening sections which are provided on the collar of the said shirt, the said band piece having another fastening section which is adapted to engage with a further fastening section that is provided in the said knot or knot like section.

There is provided in accordance with the present invention as set forth in claim 12 a necktie as set forth in claim 10 or claim 11, characterized in that at least one of the said fastening sections on the said band piece comprises snap fasteners which are secured to the said band piece coaxially on its front and rear surfaces.

There is provided in accordance with the present invention as set forth in claim 13 a necktie as set forth in any one of claims 1 to 12, characterized in that a dimple is formed on a surface of the said wider flap section of the tie body by picking up a portion thereof from its rear surface.

There is provided in accordance with the present invention as set forth in claim 14 a necktie as set forth in any one of claims 1 to 13, characterized in that a button fastener for engaging with a shirt button on the said shirt other than its first button is provided on a rear surface of the said wider flap section or a front or rear surface of the said narrower flap section of the tie body at a position that can adjustably be varied corresponding to the position of the said shirt button. This makeup permits a button and a button fastener to serve as a substitute for a normal tie clip.

There is provided in accordance with the present invention as set forth in claim 15 a necktie as set forth in claim 14, characterized in that the said shirt button for engagement by the said button fastener is a button with a snap fastener having functions of both the button and the snap fastener.

There is provided in accordance with the present invention as set forth in claim 16 a necktie characterized by being in the form of a band piece having fastening sections at both ends thereof which are adapted to engage with fastening sections which are provided at the collar of a shirt. This necktie unlike an ordinary necktie eliminates a wider and a narrower flap section which could be a hindrance when a box or the like is carried with hands.

There is also provided in accordance with the present invention as set forth in claim 17 a bow or ribbon tie characterized by being adapted to be attached to the collar of a shirt by a fastening means connectable to the color of a shirt.

There is also provided in accordance with the present invention as set forth in claim 18 a shirt to which a necktie as set forth in any one of claims 1 to 17 is adapted to be fitted. This shirt has, for example, fastening sections provided at its collar and a button with a snap fastener attached thereto.

There is also provided in accordance with the present invention as set forth in claim 19 a button with a snap fastener characterized by having functions of both the button and the snap fastener.

There is also provided in accordance with the present invention as set forth in claim 20 a napkin characterized by having at least one snap fastener attached thereto.

A necktie according to the present invention, of which a knot or knot like section is only arranged and required to be attached to the collar of a shirt by a fastening means, can be fitted and detached very easily. Also, since the ring of a string need not be hung around the neck area and since the first button of a shirt need not be fastened, the oppression around the neck area during fitting is made nil so that there will not be flow of the blood getting worse and not be having a stiff shoulder. Further, easily coming off if pulled by a stranger, the necktie is high in safety. Also, the body heat is easily escaped and it is cool in the summer season. Also, since it can only be done to use a simple fastening means and to form a knot like section upon forming a constriction by folding and stitching or tying with a string or to form a knot or knot like section in an ordinary tying manner, the necktie can be manufactured inexpensively. Also, formed with a knot like section simply by folding to provide a constriction in a region of a fold or crease, the necktie is continuous in pattern and excels in appearance. Further, changing the positions of the crease and the constriction allows changing the size of the knot like section and adjusting the length of the necktie when fitted. Also, separating a pair of fastening sections from each other allows the necktie to be returned to the state that it is untied and thus to be washed and to retain its shape when washed.

BEST MODES FOR CARRYING OUT THE INVENTION

Figure 1:
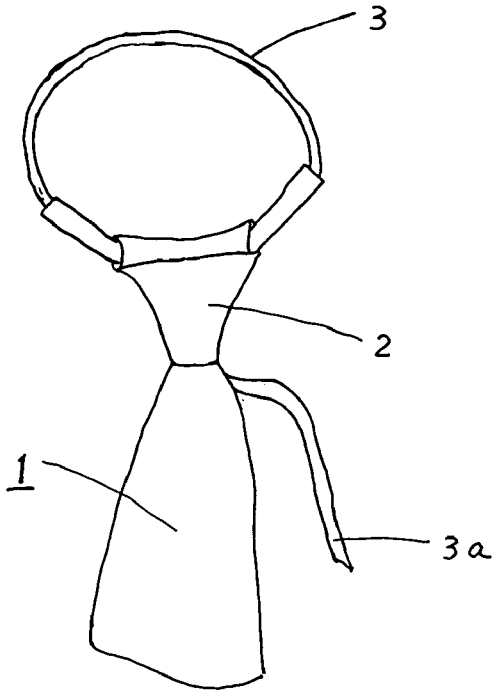
FIG. 1 is a view illustrating the essential parts of a necktie as Example 1 in the prior art.
Figure 2:
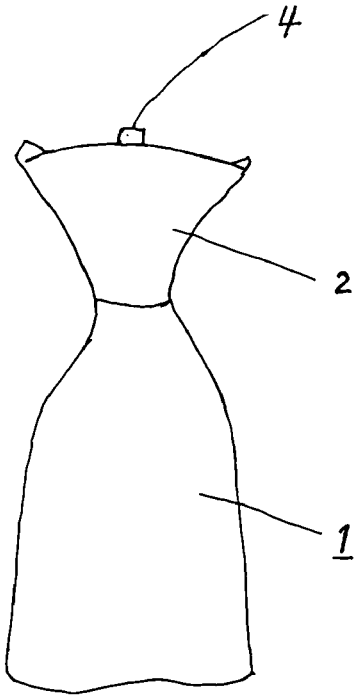
FIG. 2 is a view illustrating the essential parts of a necktie as Example 2 according to the prior art.

Hereinafter, the present invention will be described in detail with reference to embodiments thereof illustrated in the drawing figures.

Figure 3:
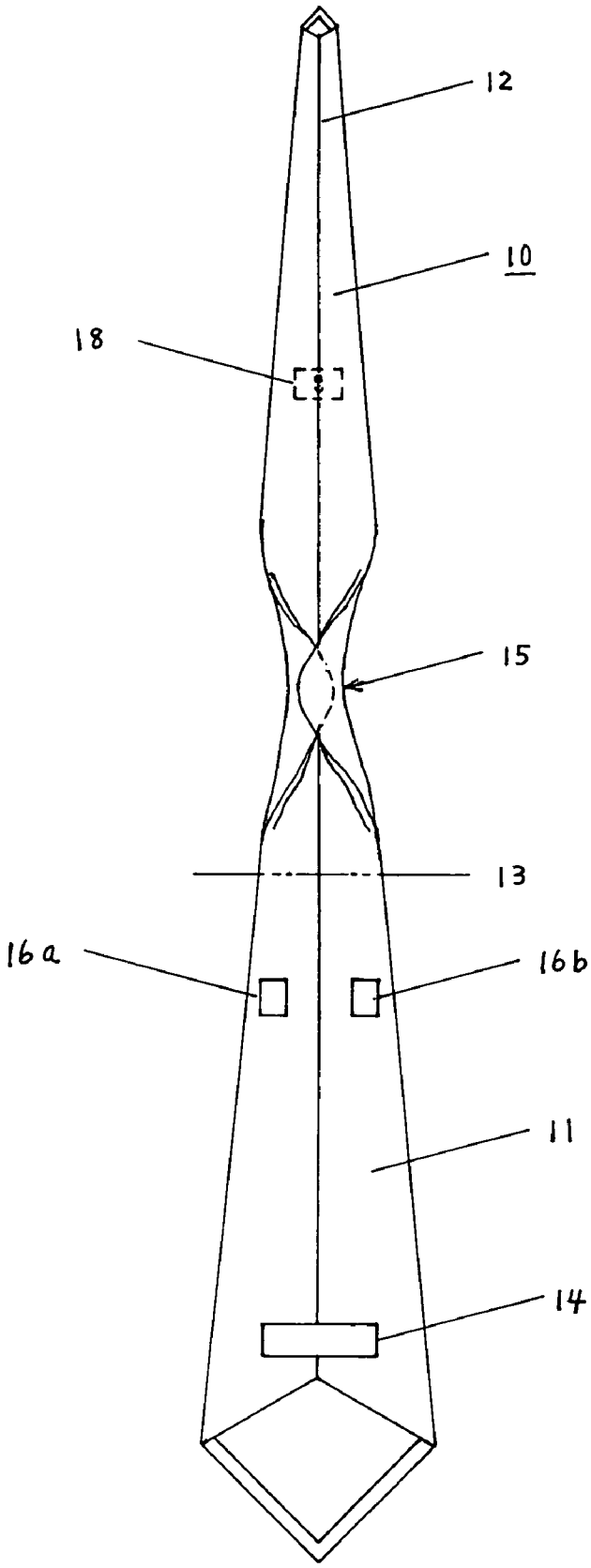
FIG. 3 is a view of development illustrating a first embodiment of the necktie according to the present invention.
Figure 4:
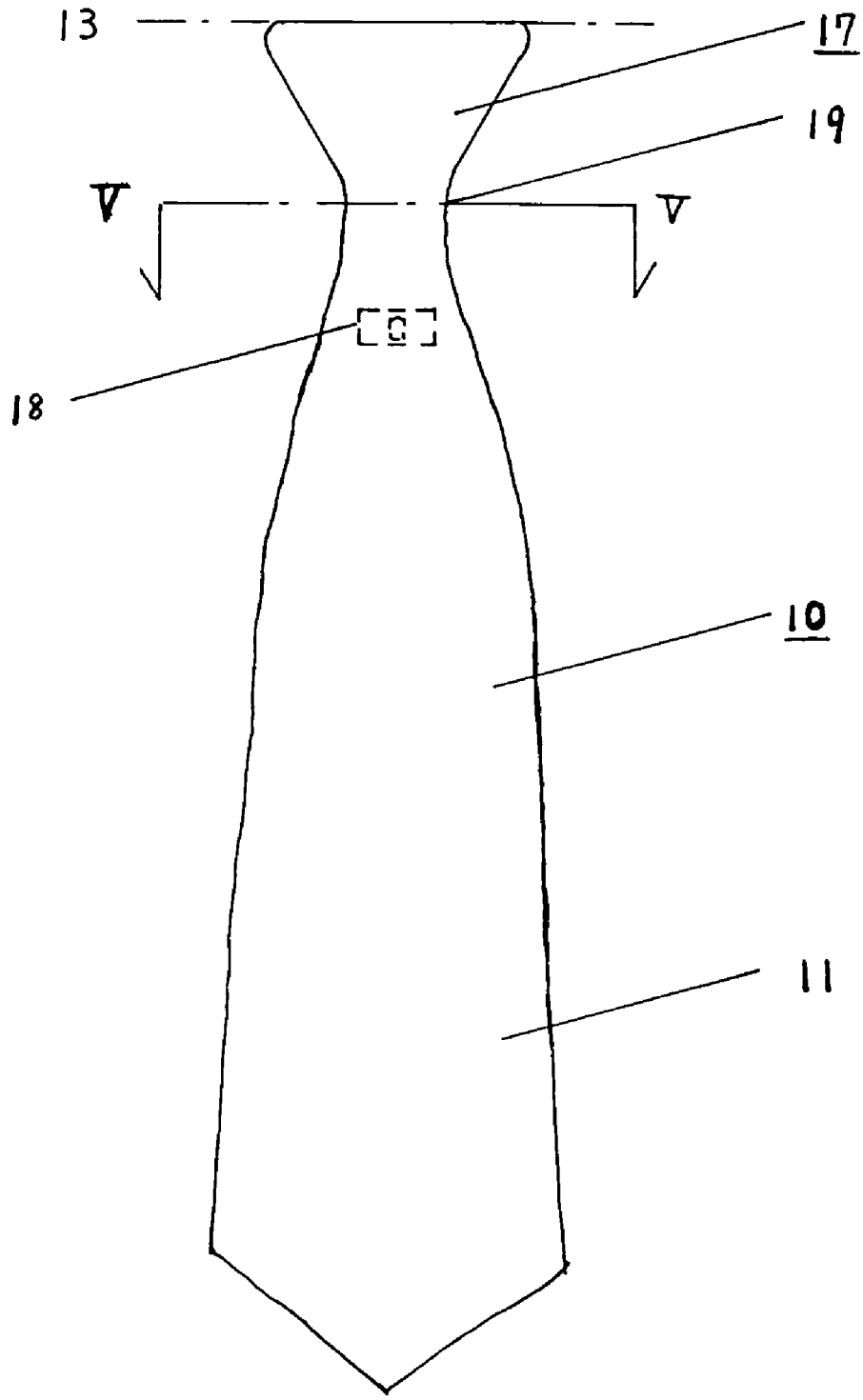
FIG. 4 is a view illustrating a basic form of the first embodiment when fitted.
Figure 5:
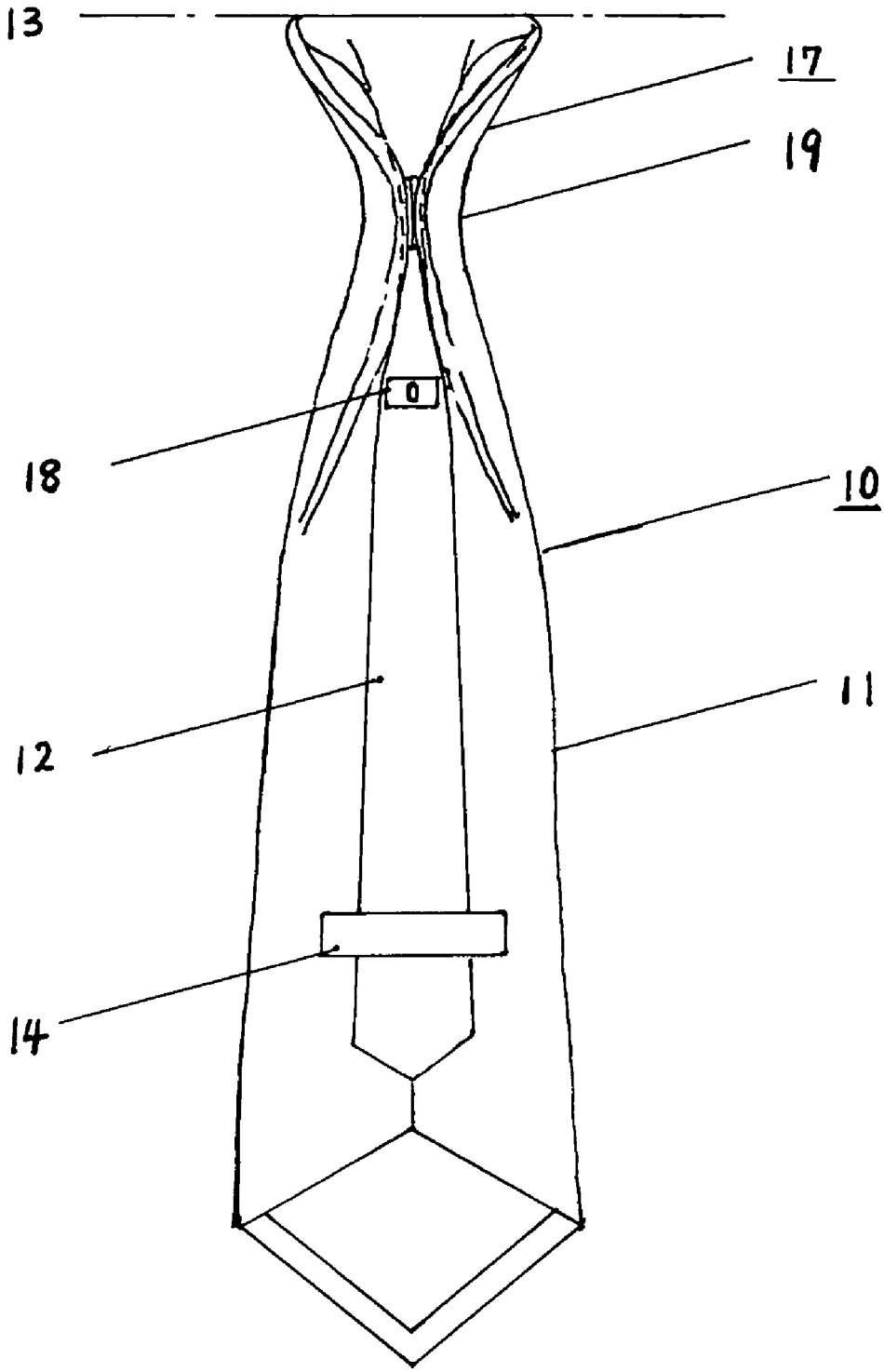
FIG. 5 is a rear view of FIG. 4.

FIG. 3 is a view of development illustrating a first embodiment of the necktie according to the present invention; FIG. 4 is a view illustrating a basic form of the first embodiment when fitted; FIG. 5 is a rear view of FIG. 4; and FIG. 6 is a cross sectional view of FIG. 4 taken along the line V-V.

A necktie 10 according to the present invention comprises a wider flap section 11 and a narrower flap section 12 and is designed to take its basic form when fitted, by folding the tie body 10 along a crease 13 between the wider and narrower flap sections 11 and 12 so that rear surfaces of these sections face each other. Also, as in an ordinary necktie, the wider flap section 11 has a stopper for narrower flap section 14 attached to a suitable rear surface area thereof for passing the narrower flap section 12 to hold the latter in place.

And, edges of the narrower flap section 12 in the vicinity of the crease 13 are folded along a longitudinal center line from its front to rear side, and if needed are tied with a string or stitched together, to form a reduction of area 15 there. In this connection, note that the reduction of area 15 may alternatively be formed by folding edges of the narrower flap section 12 along the longitudinal center line from its rear to front side. After the reduction of area 15 is formed, the tie body 10 is folded along the crease 13, and then edges of the wider flap section 11 are folded to wrap the reduction of area 15 therewith and secured together to form a constriction 19 there, thereby forming a knot like section 17 between the constriction 19 and the crease 13. In this connection, note that to secure the edges of the wider flap section 11, there is a method in which as shown in FIG. 3 the wider flap section 12 is provided on its rear surface with a pair of fastener sections 16*a* and 16*b* (e.g., made of snap fasteners, Velcro fasteners or hooks) which are adapted to be fastened together. Also, although not shown, the edges of the wider flap section 12 may be stitched together, or may be tied together with a string or scarf.

Figure 6:
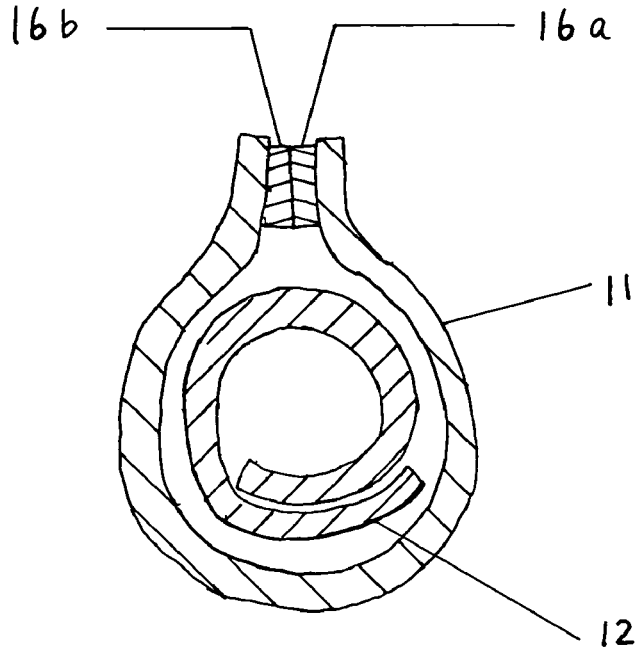
FIG. 6 is a cross sectional view of FIG. 4 taken along the line V-V.
Figure 7:
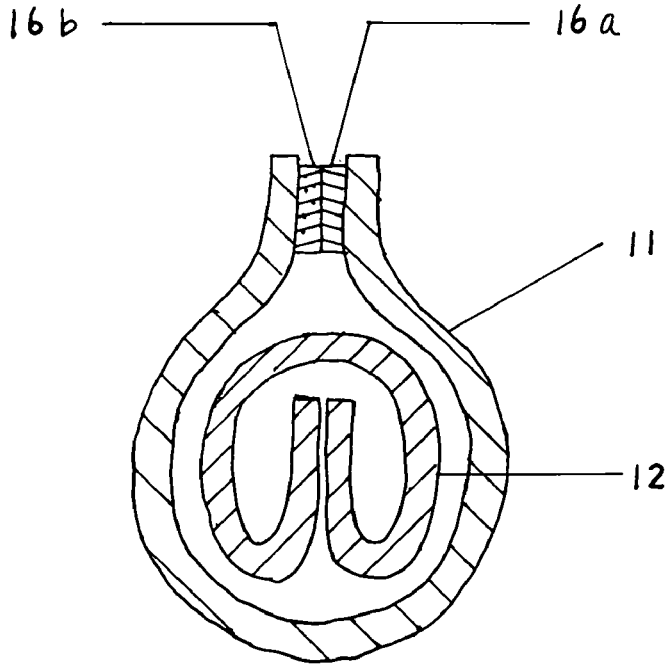
FIG. 7 is a cross sectional view of an alternative embodiment taken along the line V-V in FIG. 4.

The part corresponding to the constriction 19 shown in FIG. 4 and FIG. 5 as its rear view has a cross section as shown in FIG. 6. In this connection, note that when the reduction of area 15 is formed, the narrower flap section may be doubly folded as shown in FIG. 7.

Figure 8:
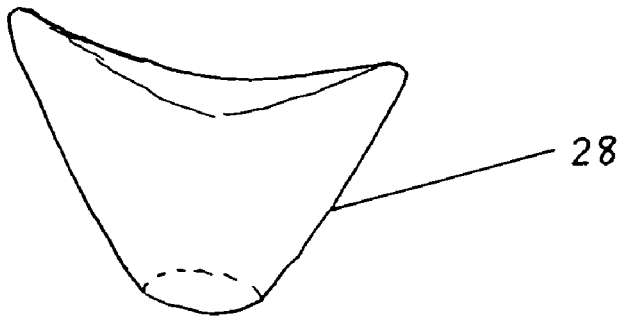
FIG. 8 is a perspective view illustrating a shaping element inserted in a knot or knot like section in the first to a sixth embodiment for the necktie according to the present invention.
Figure 9:
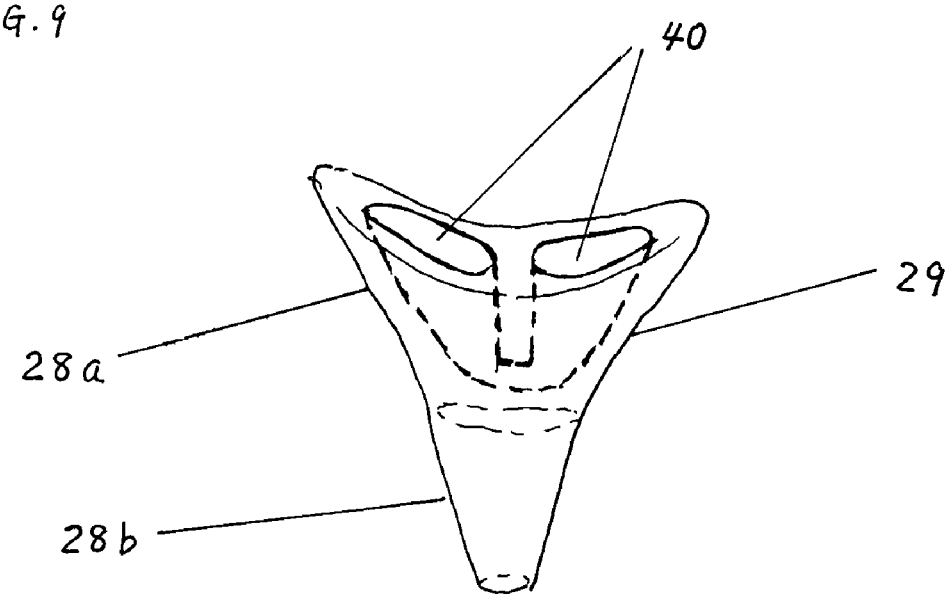
FIG. 9 is a perspective view illustrating an alternative shaping element inserted in a knot or knot like section in the first and sixth embodiments for the necktie according to the present invention.

Also, a solid body 28 that is generally triangular as shown in FIG. 8 or another solid 29 which has a body section 28*a* that is generally triangular and a drooping section 28*b* as shown in FIG. 9 may, as a shaping element, be inserted in the knot like section 17 to shape it neatly. Such a shaping element may be formed with a hole 40 for passage by the fastening means.

Also, a button fastener 18 for engaging with a shirt button on a shirt other than its first button is provided on a rear surface of the wider flap section 11 or on a front or rear surface of the narrower flap section 12 at a position spaced from the constriction 19. As this button fastener 18, use may be made of a band piece with a button, a snap fastener adapted to be fitted with a snap fastener of a button with snap fastener 70 to be described later, or a button hole directly formed in the narrower flap section 12.

Figure 10:
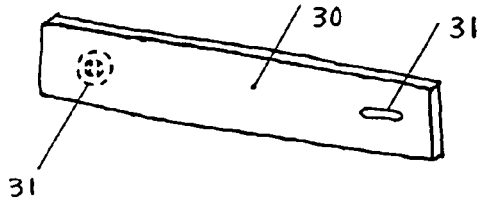
FIG. 10 is a perspective view illustrating a fastening means in the first and sixth embodiments.
Figure 11:
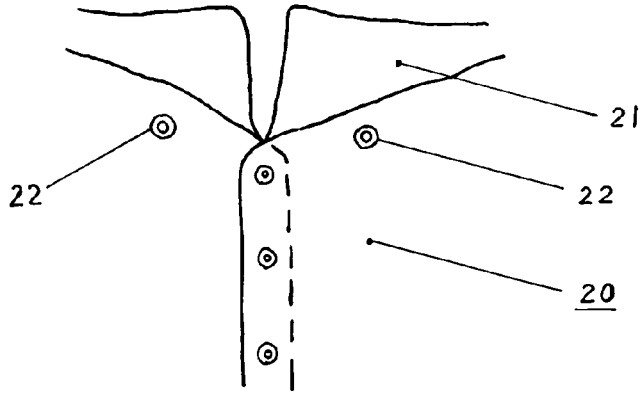
FIG. 11 is a view illustrating a state of a shirt to which the fastening means shown in FIG. 10 is attached.
Figure 12:
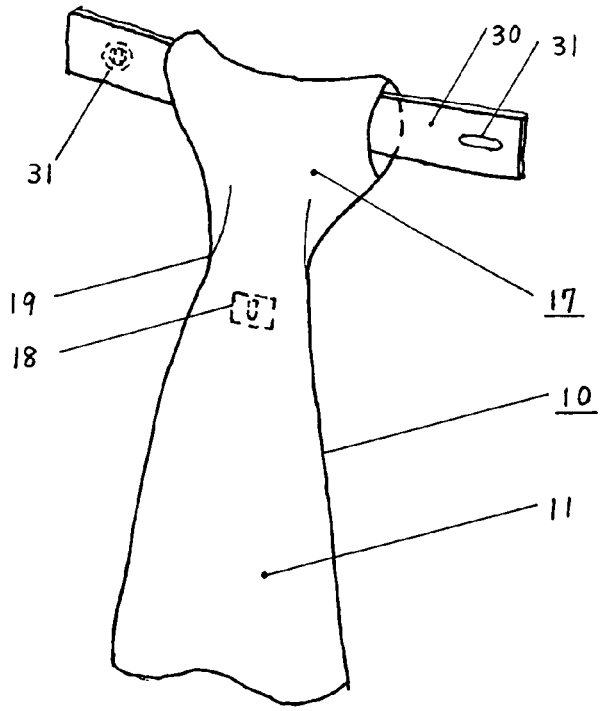
FIG. 12 is a perspective view illustrating a state that the fastening means of FIG. 10 is passed though the knot like section 17 of the necktie.
Figure 13A:
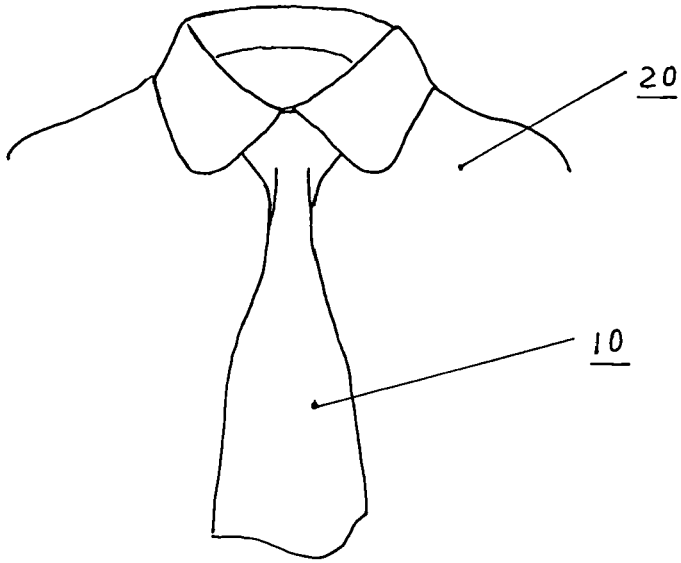
FIG. 13*a* is a view illustrating that the necktie of the first embodiment is fitted to a shirt.
Figure 13B:
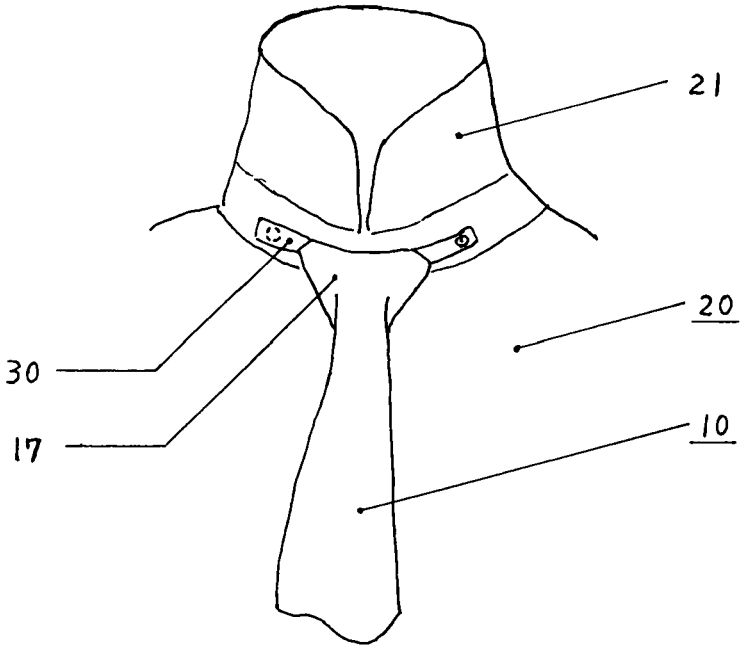
FIG. 13*b* is a view illustrating the state that a collar of the shirt of FIG. 13 is turned up.

FIG. 10 shows a band piece or strip 30 used as the fastening means in a necktie 10 in the present embodiment. Also, FIG. 11 shows fastening sections 22 provided on the collar of a shirt 20 for engagement with those of this band piece 30. In FIG. 11, the collar 21 of the shirt is shown as turned up. Also, FIG. 12 shows the state after the band piece 30 is passed through the knot like section 17. Further, FIG. 13*a* shows the state that the necktie 10 of the present invention is fitted onto the shirt 20 with the fastening sections 31 engaged with the fastening section 22. FIG. 13*b* shows the state that the collar 21 of the shirt shown in FIG. 13*a* is turned up.

Figure 14:
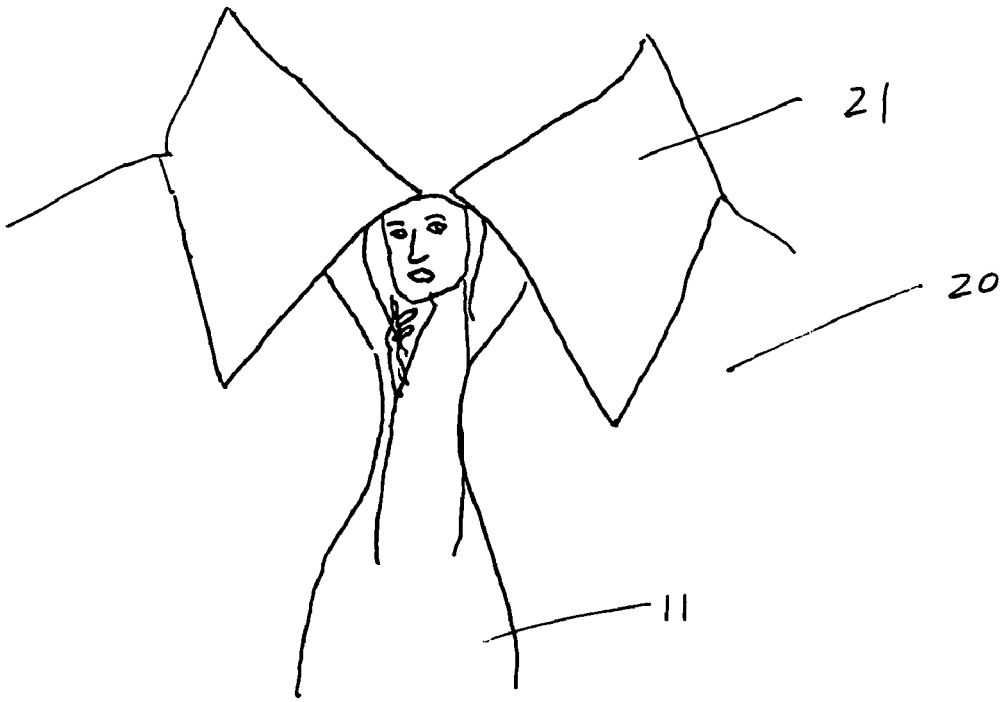
FIG. 14 is a view illustrating that a pattern is continuous in the first embodiment.

The necktie shown in FIGS. 13*a* and 13*b* is a novel necktie which has so far never existed, in which a pattern appears as it is without discontinuing, and which excels in appearance. An example is shown in FIG. 14 in which a human head is drawn on the knot like section, continuing to its torso drawn on the wider flap section.

By the way, providing the button fastener 18 as shown in FIG. 12 keeps the necktie 10 retained on the shirt 20 if the band piece 30 is removed from the shirt 20, thus preventing the necktie 10 from falling and from getting dirty. Also, a rise of the necktie 10 can be curbed.

For the band piece 30 shown in FIG. 10, a material having some degree of stretchability and flexibility is suitable such as a rubber product, cloth or plastic. Each of the fastening sections 31 at its both ends, with consideration given to the fact that a shirt 20 to be fastened to is washed, is suitably of detachable type and may be a snap fastener, Velcro fastener, button, button hole, hook or the like. In this connection, note that the fastening sections 31 at right and left hand sides may be different in type from each other; as shown in FIG. 10, a snap fastener and a button hole may be at the left and right hand sides, respectively. Also, these fastening sections 31 are attached to the band piece 30 by means of stitching, bonding, caulking or the like, and the fastening sections 22 shown in FIG. 11 are likewise attached to the shirt 20.

Thus, according to the present embodiment, fitting is very easy as mentioned above. Also, oppression around the neck area during fitting is nil, and there can not be having a deteriorated flow of the blood or stiff shoulders. Also, the body heat is easy to escape, and it is cool in the summer season. Also, since it can only be done to use a simple band piece 30 and to make a minor change to an ordinary necktie such as providing a constriction 19 and a button fastener 18, the cost of manufacture is low. Also, as it is sufficient to simply fold followed by forming a knot like section 17 by providing a constriction 19 in the vicinity of a crease 13, a necktie is provided that is continuous in pattern and excels in appearance. Further, changing the positions of the crease 13 and the constriction 19 allows the size of the knot like section 17 to be altered and the length of the necktie when fitted to be adjusted. Also, detaching a pair of fastener sections 16*a* and 16*b* from each other allows the necktie to be easily returned to the state shown in FIG. 3, namely to the developed state and hence to be washed and to retain its shape when washed. Further, if a pair of fastener sections 16*a* and 16*b* are detached, the button fastener 18 is unfastened and a reduction of area 15 is unfolded, unstitched or untied, the necktie can be returned easily to the ordinary state.

Figure 15:
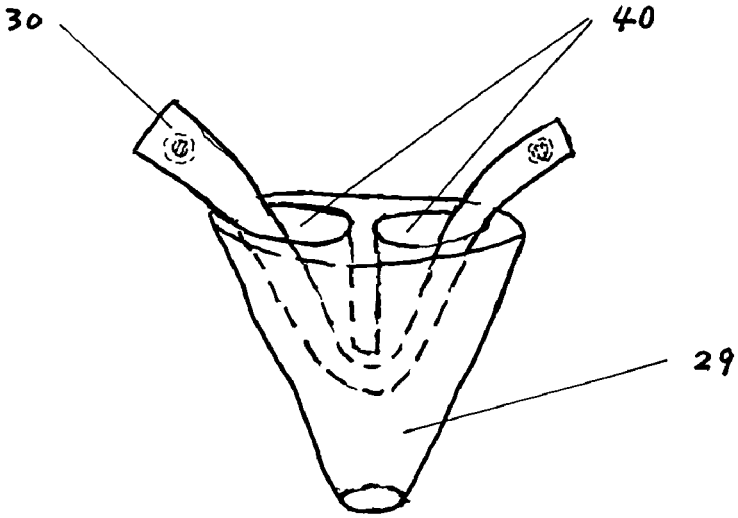
FIG. 15 is a view illustrating a shaping element and a fastening means in a second embodiment.
Figure 16A:
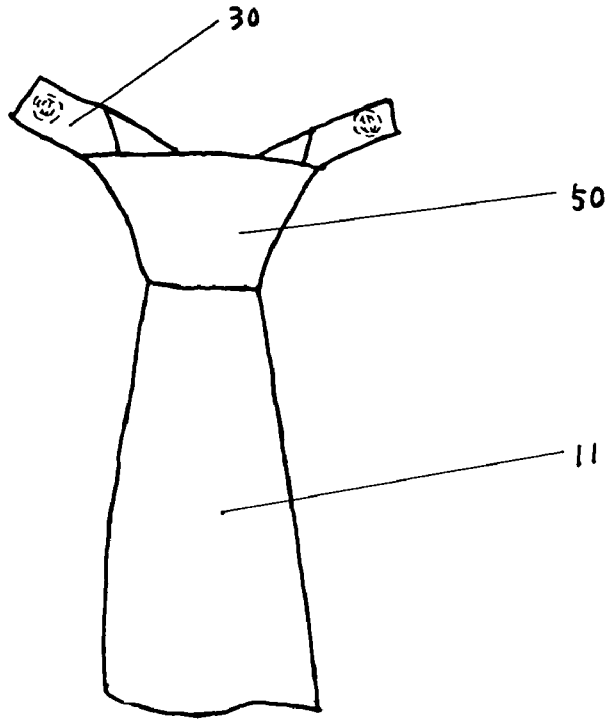
FIG. 16*a* is a front view of the necktie in the second embodiment.
Figure 16B:
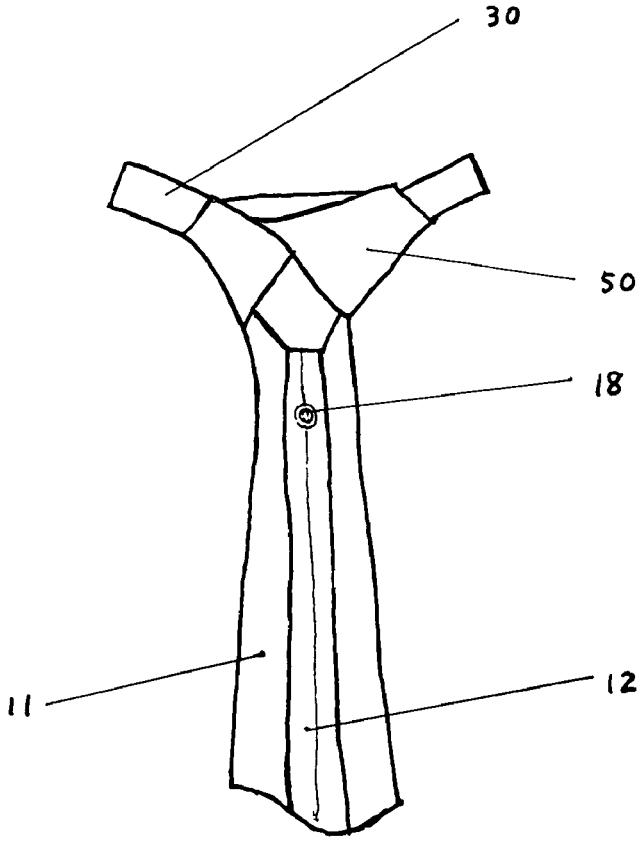
FIG. 16*b* is a rear view of the necktie in the second embodiment.
Figure 17A:
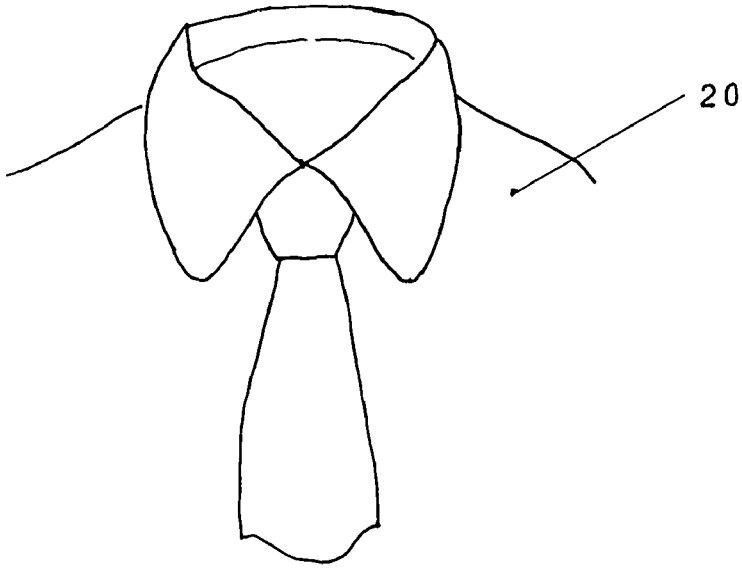
FIG. 17*a* is a view illustrating that a necktie according to a third or fourth embodiment is fitted onto a shirt.
Figure 17B:
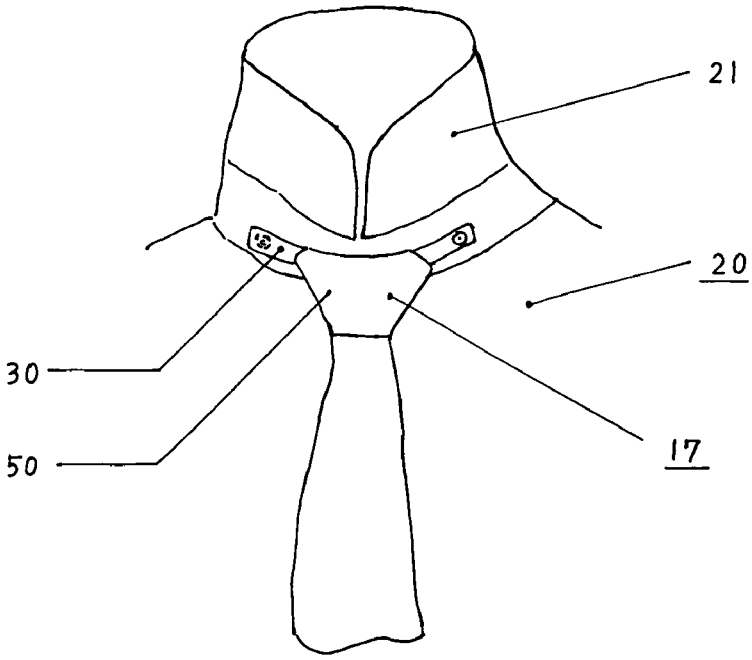
FIG. 17*b* is a view illustrating the state that a collar of the shirt shown in FIG. 17 is turned up.

Also, in a second embodiment of the necktie according to the present invention, if as shown in FIG. 15 a band piece 30 is passed though a hole 40 of a shaping element 29 and a necktie is tied around the shaping element 29 in an ordinary manner of tying (basically such as the semi-Windsor or Windsor knot with the exception that there is no neck-encircling section), a tied form of the necktie as shown in FIG. 16*a* and FIG. 16*b* (a rear view of FIG. 16*a*) is obtained. And, fastening the band piece 30 to the collar of a shirt gives rise to the state shown in FIG. 17*a* and FIG. 17*b* (a rear view of FIG. 17*a*). Seeing FIG. 17*a* only will have everyone consider the necktie an ordinary necktie fitted around the neck but if the collar 21 of the shirt is turned up, the necktie is in fact as shown in FIG. 17*b* and is seen to be a necktie of unprecedentedly new type. Apparently unvaried from an ordinary necktie but not wound around the neck, the necktie is nil in oppression around the neck area and is refreshing when worn.

Figure 18A:
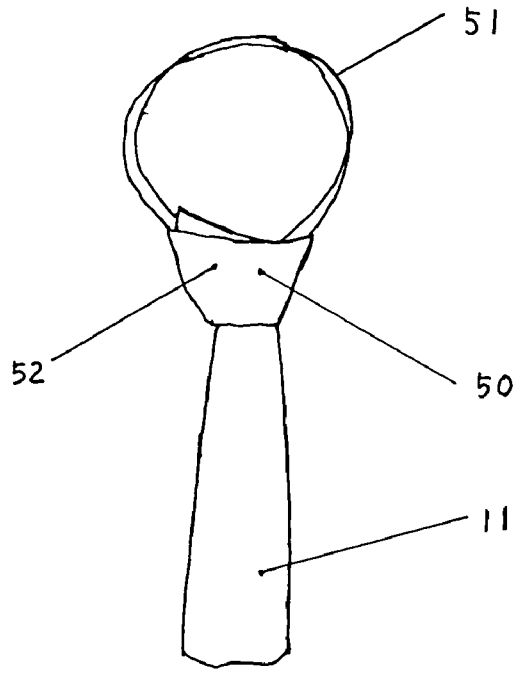
FIG. 18*a* is a front view illustrating the state that a normal necktie is hand-tied.
Figure 18B:
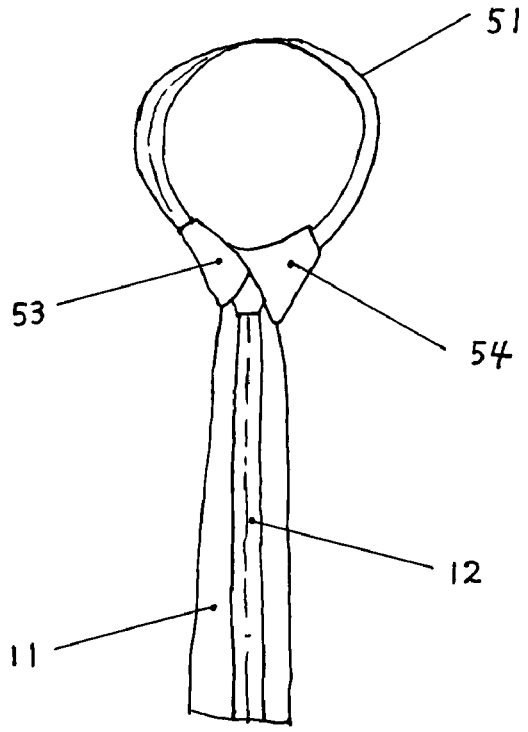
FIG. 18*b* is a rear view of FIG. 17*a;*
Figure 19A:
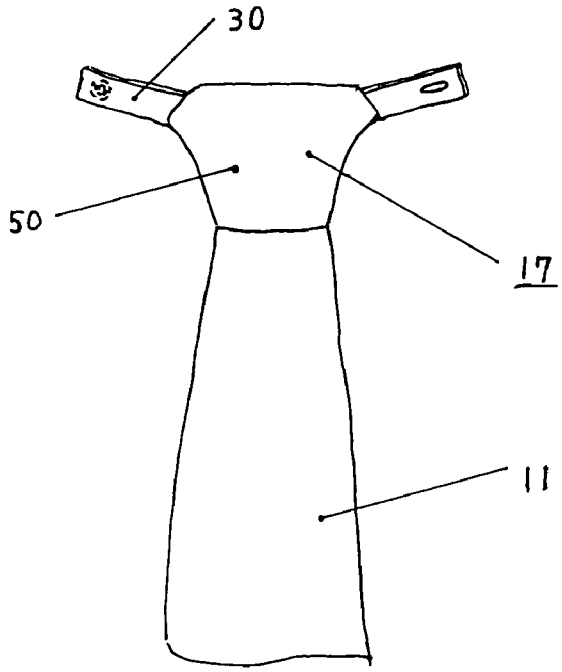
FIG. 19*a* is a front view illustrating a necktie of the third embodiment according to the present invention.
Figure 19B:
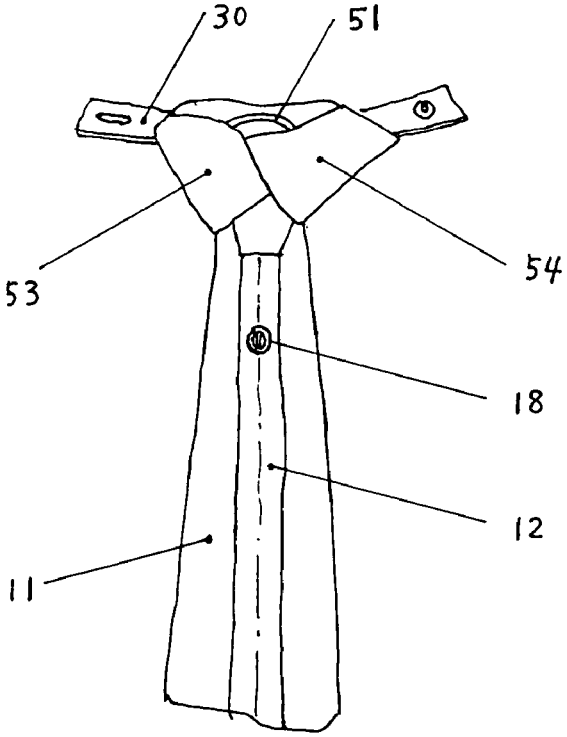
FIG. 19*b* is a rear view of FIG. 19*a;*

Also, as a third embodiment of the necktie according to the present invention, a necktie is shown which is tied in an ordinary tying manner (such as the semi-Windsor or Windsor knot) as shown in FIG. 18*a* and FIG. 18*b* (a rear view of FIG. 18*a*) and a band piece 30 is passed though a knot like section 17 including a knot 50 as shown in FIG. 19*a* and FIG. 19*b* (a rear view of FIG. 19*a*) and then fastened to the collar of a shirt to cause the necktie to be suspended. The necktie of FIGS. 18*a* and 18*b* is tied in the ordinary manner so that its neck encircling section 51 is wound around the neck. If its narrower flap section 12 is pulled, the neck encircling section 51 is reduced in diameter and comes to be hidden in a front knot section 52 of the knot 50, resulting in the state shown in FIG. 19*a* and FIG. 19*b* (its rear view). Thus, referring to FIGS. 19*a* and 19*b*, the piece band 30 is passed through a left and a right hand side knot portion 54 and 53 and then the narrower flap section 12 is pulled to pull the neck encircling section 51 into the knot 50 to form the knot like section 17. Coupling the necktie of this embodiment to the fastening sections 22 of FIG. 11 gives rise to the state shown in FIGS. 17*a* and 17*b*.

Figure 20A:
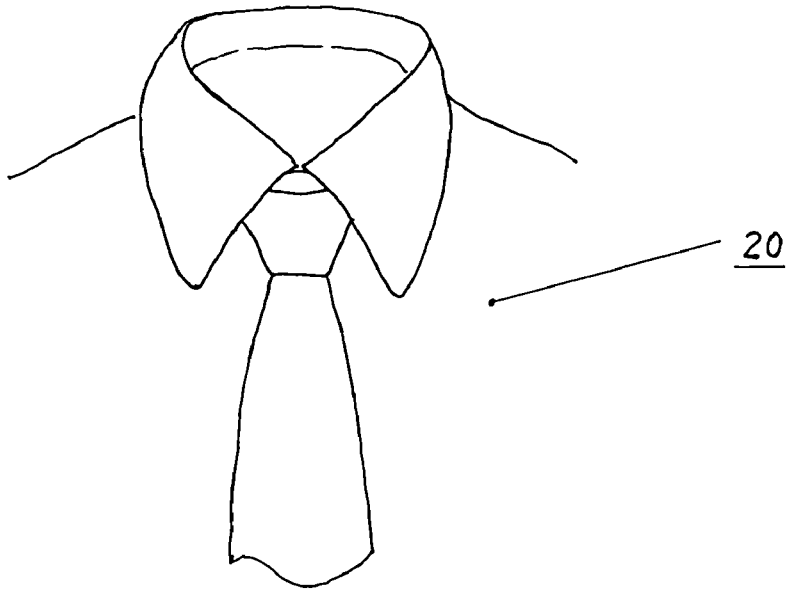
FIG. 20*a* is a view illustrating the state that a necktie of the fourth embodiment is fitted onto a shirt.
Figure 20B:
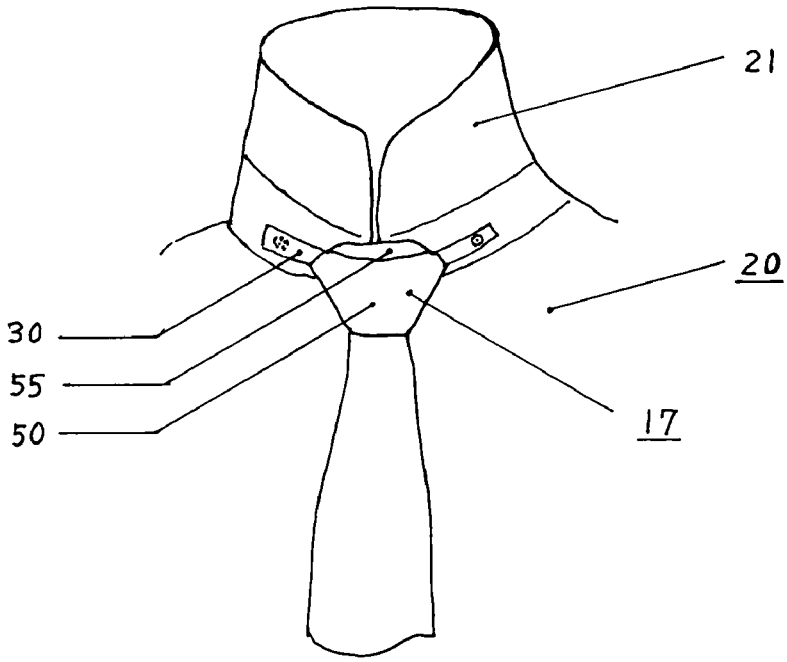
FIG. 20*b* is a view illustrating the state that the collar of the shirt shown in FIG. 20*a* is turned up.
Figure 21A:
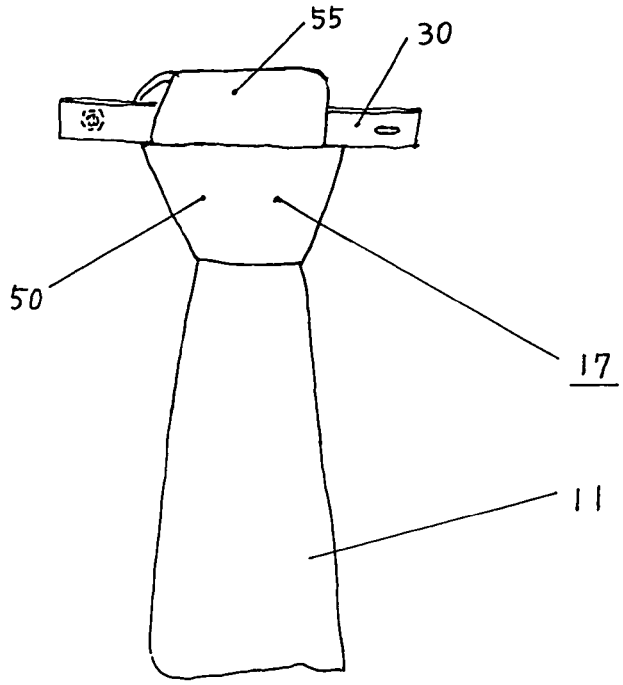
FIG. 21*a* is a front view illustrating a necktie according to the fourth embodiment.
Figure 21B:
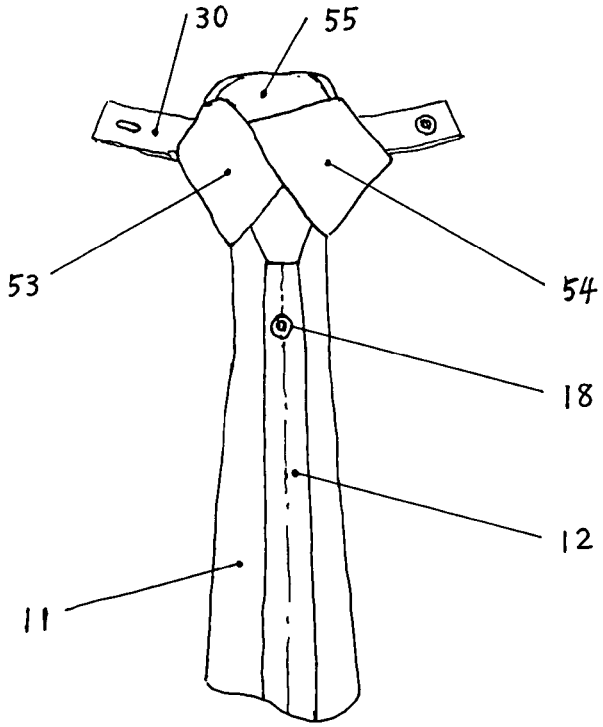
FIG. 21*b* is a rear view of FIG. 21*a;*

Mention is next made of a necktie of novel type as shown in FIGS. 20*a* and 20*b* which represents a fourth embodiment of the present invention. FIG. 20*b* shows the state that the collar 21 of a shirt as shown in FIG. 20*a* is turned up. The necktie removed from the collar of the shirt 20 as shown in these Figures is shown in FIG. 21*a* and FIG. 20*b* (a rear view of FIG. 20*a*). This necktie is characterized in that a section of the neck encircling section 55 is left exposed above the ordinary necktie knot 50. Thus, after the band piece 30 is passed through a left and a right hand side knot portion 54 and 53 a knot like section 17 is formed by pulling the narrower flap section 12 so as to leave a section of the net encircling section 55 above a front knot portion 52 as shown in FIGS. 21*a* and 21*b*. And, coupling the necktie of this embodiment to the fastening sections 22 of FIG. 11 gives rise to a necktie of totally new design as shown in FIGS. 20*a* and 20*b*. This new type of necktie has the knot doubled into upper and lower sections which can be varied in color so that a variation in color can be enjoyed. Also, it is conceivable to decorate the upper section with a crest of a company.

Figure 22A:
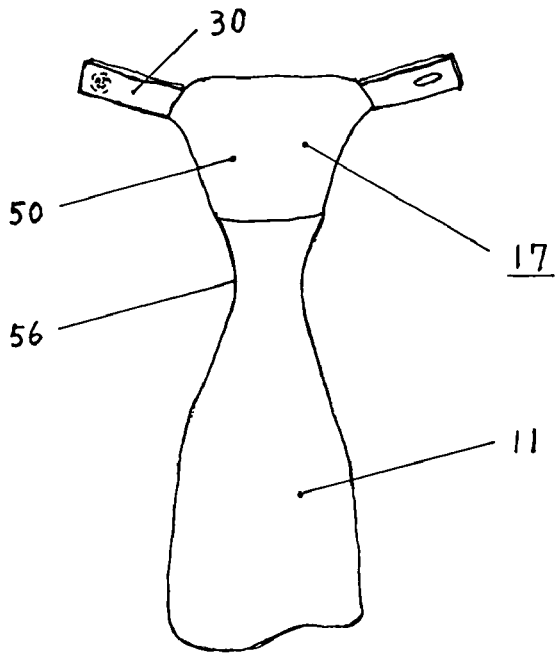
FIG. 22*a* is a front view illustrating a necktie according to a fifth embodiment of the present invention.
Figure 22B:
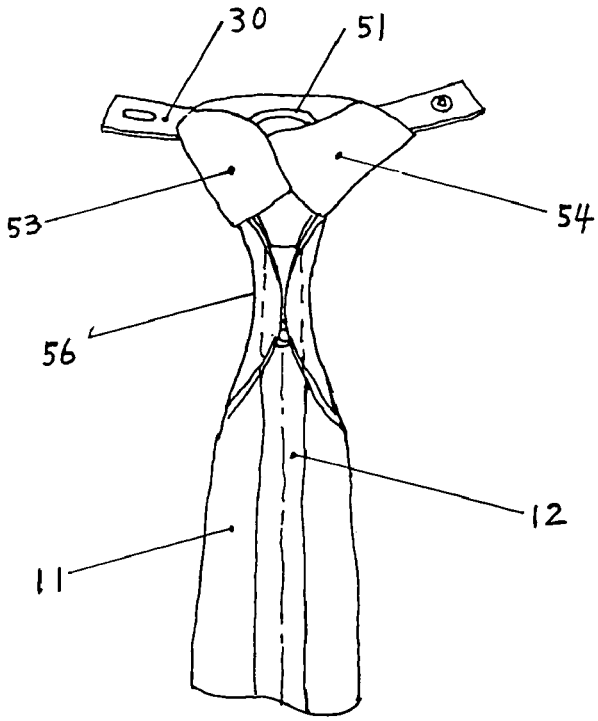
FIG. 22*b* is a rear view of the necktie according to the fifth embodiment.

Also conceivable is a necktie of unprecedented design as shown in FIG. 22*a* and FIG. 22*b* (a rear view of FIG. 22*a*) that represents a fifth embodiment of the present invention, in which a constriction 56 is formed below the knot like section 17 for each of the neckties of the second to fourth embodiments. Thus, referring to FIGS. 16*a*, 16*b*, 19*a*, 19*b*, 21*a* and 21*b*, opposite edges of the wider flap section 11 are folded and fastened (as in a manner such as to form the constriction 19) to wrap the narrower flap section 12 therewith beneath the knot like section 17 or the knot 50 and thereby to form the constriction 56 beneath the knot like section 17 or the knot section 50. The necktie of this embodiment is not different in shape at all from an ordinary necktie which is wound around the neck, and is expected to supplant an ordinary necktie. By the way, the narrower flap section 12 may be provided on its rear surface with the button fastener 18 that is for engaging with a button on a shirt 20 other than its first button.

Figure 23:
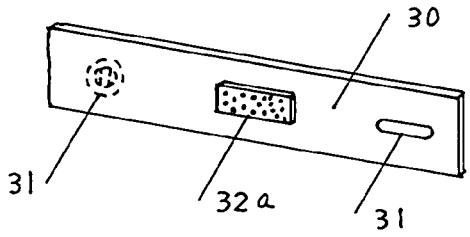
FIG. 23 is a perspective view illustrating a fastening means used in the sixth embodiment of a necktie according to the present invention.
Figure 24:
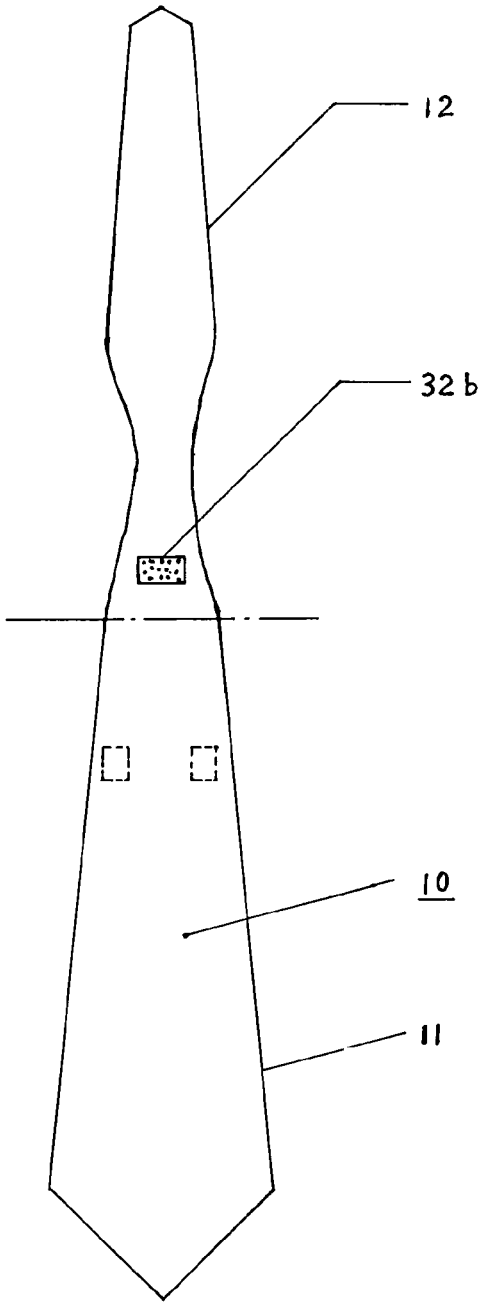
FIG. 24 is a view illustrating the essential parts of a necktie according to the sixth embodiment.

In a sixth embodiment of the present invention, a band piece or stripe 30 has a snap fastener, button, Velcro tape, hook or the like attached thereto as a fastener section 32*a* as shown in FIG. 23 and a necktie 10 has its counterpart attached thereto as a fastener section 32*b* as shown in FIG. 24 to cause the tie body 10 to be suspended from the collar of a shirt 20.

Figure 25A:
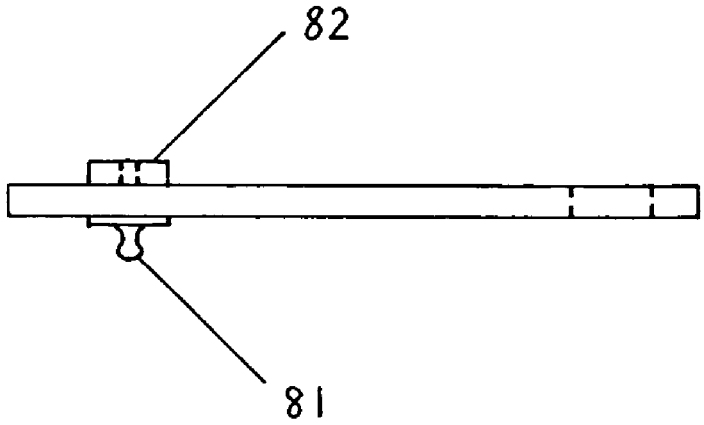
FIG. 25*a* is a plan view of a band piece with a snap pair.

As mentioned above, a necktie of each of the second to sixth embodiment in which a knot 50 or knot like section 17 is made in an ordinary tying manner can be fitted simply to the collar of a shirt 20, is nil in oppression around the neck area, and is high in safety since it can come off easily if pulled by a stranger. The necktie can be returned to its original state for washing and it is especially convenient in the summer season. Above all, using this necktie saves a person the trouble of tying a necktie before gong to work each day and gives rise to various advantages including that its service life can be extended. Consequently, it is believed that those disagreeable with a necktie use a necktie of the present invention willingly Next, a band piece or strip 80 with a snap pair that is fitted with a snap fastener is shown in FIG. 25*a* (plan view) and FIG. 25*b* (front view). This band piece with snap pair 80 has at least one of its fastening sections made of a male and a female snap secured coaxially to its front and rear surfaces, there being indicated the male snap fastener, the female snap fastener and a button hole at 81, 82 and 83, respectively.

If the band piece with snap pair 80 is used for the band piece 30 for the necktie 10 shown in FIG. 12 and, as shown in FIG. 13*b* the necktie 10 is fitted to the shirt 20 (with a button with snap fastener 70 used for each of the fastening sections 22 in FIG. 11), the male snap fasteners 81 are supposed to lie at the right and left hand sides of the collar of the shirt 20. If these male snap fasteners 81 are used in conjunction with a napkin (having mating female snap fasteners 82) so that the female snap fasteners 82 mate with the male snap fasteners 81), one can conveniently finish eating without getting dirt on one's necktie 10 or shirt 20. Other than this example, the utilization of the button with snap fastener 70 and the band with snap pair 80 is of wide range as they can be used to fasten together and unfasten things to which they are secured, and is not only to neckties but rather to clothes in general.

Figure 26:
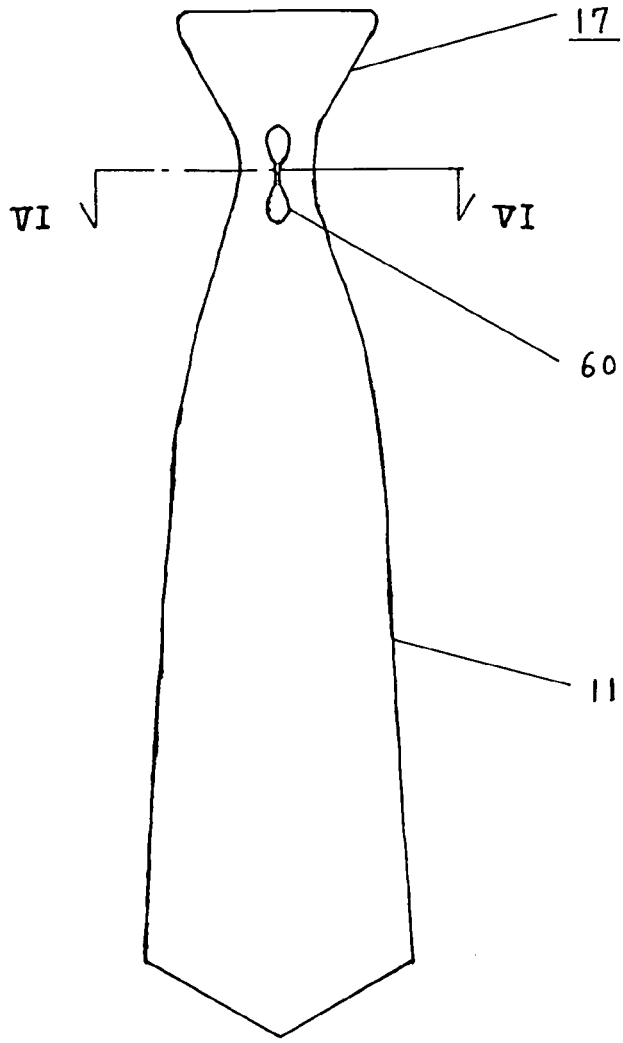
FIG. 26 is a view illustrating a dimple for the necktie.
Figure 27:
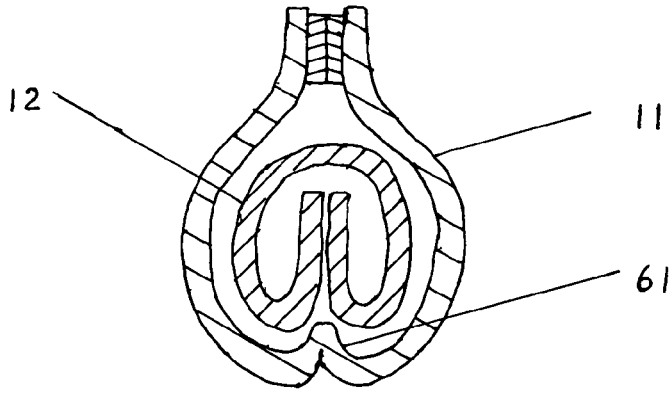
FIG. 27 is a cross sectional view taken along the line VI-VI in FIG. 26.

Of late, it is becoming popular to setting a dimple on a necktie, which in the present invention is shown in FIG. 26. FIG. 27 is a cross sectional view taken along the line VI-VI in FIG. 26. A dimple 60 is formed beneath a knot like section 17. This is made on a surface of the wider flap section 11 by picking up a portion thereof 61 from its rear surface as shown in FIG. 27. In picking up the portion 61, stitching or clipping the wider flap section 11 or the like is conceivable.

Figure 28A:
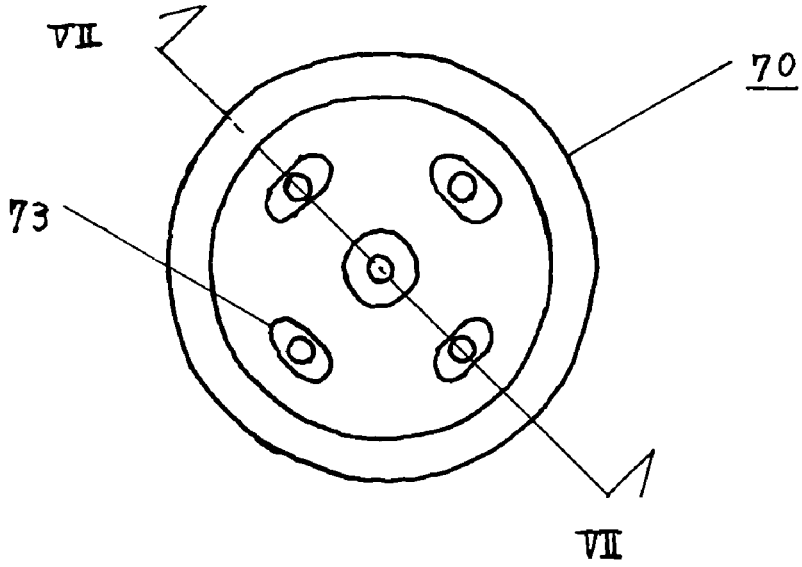
FIG. 28*a* is a front view illustrating a button with a snap fastener for a shirt to be fastened to a button fastener.
Figure 28B:
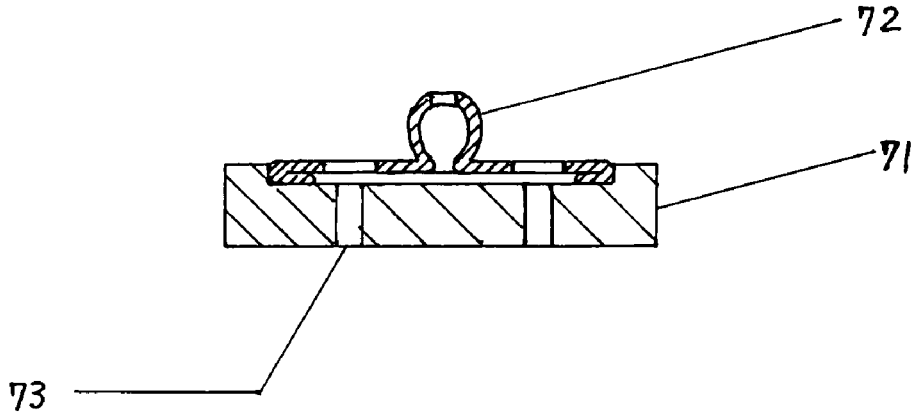
FIG. 28*b* is a cross sectional view taken along the line VII-VII in FIG. 28*a;*
Figure 29A:
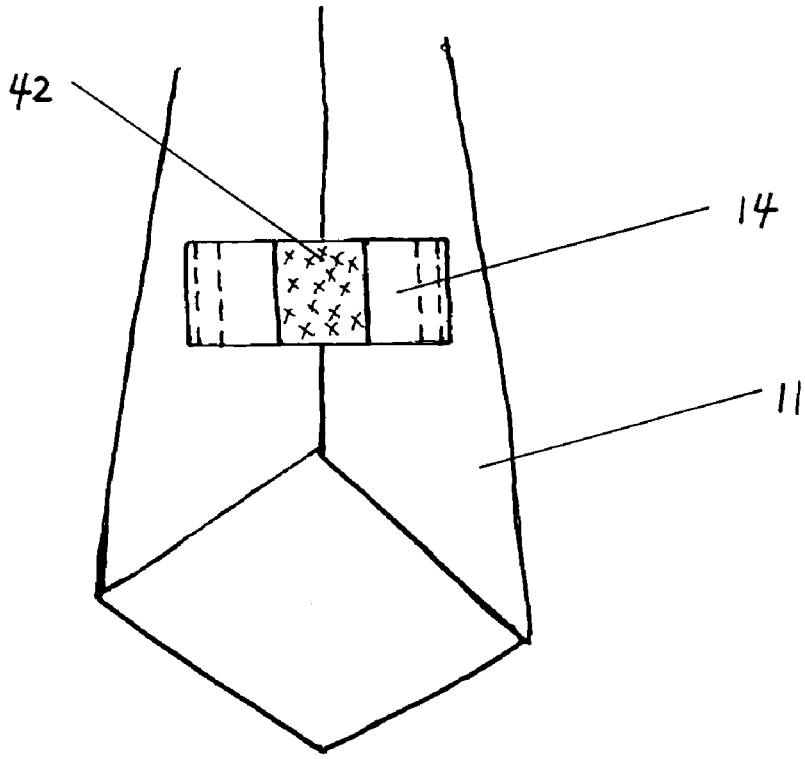
FIG. 29*a* is a view illustrating the male of a Velcro fastener attached to a stopper for narrower flap section as a part of the button fastener.
Figure 29B:
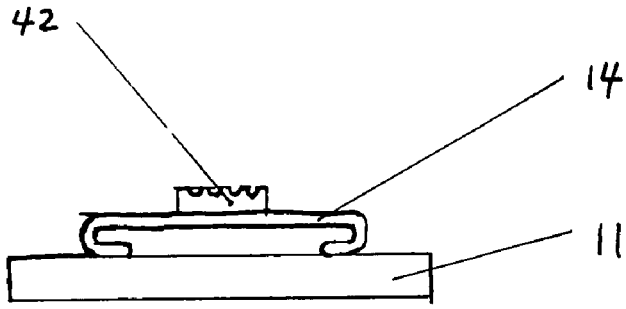
FIG. 29*b* is a bottom view of FIG. 29*a;*

As mentioned above, providing the button fastener 18 on a front or rear surface of the narrower flap section 12 to secure it to a button on a shirt 20 other than its first button as shown in FIGS. 12, 19*b* and 21*b* can keep the necktie from falling and getting dirty while preventing a rise of the necktie. With a snap fastener used as the button fastener 18, the button with snap fastener 70 has been invented as its mating counterpart. Thus, as shown in FIG. 28*a* and FIG. 28*b* (a cross sectional view taken along the line VII-VII in FIG. 28*a*), the button with snap fastener 70 is made by forming a surface of a button 71 with a dent of a diameter a little larger than that of a snap fastener 72 and pasting its surface and the bottom surface of the snap fastener 72 together with an adhesive agent. The button with snap fastener 70 may, however, be made by pasting without forming the dent on the button. And, the button with snap fastener 70 is secured to a shirt 20, using button holes 73 stitched thereto, and is fastened to the button fastener 18. The button with snap fastener 70 can be made by molding (from a material such as nylon or urea), and it is possible to manufacture the button integrally with the snap fastener in a mold.

Figure 30A:
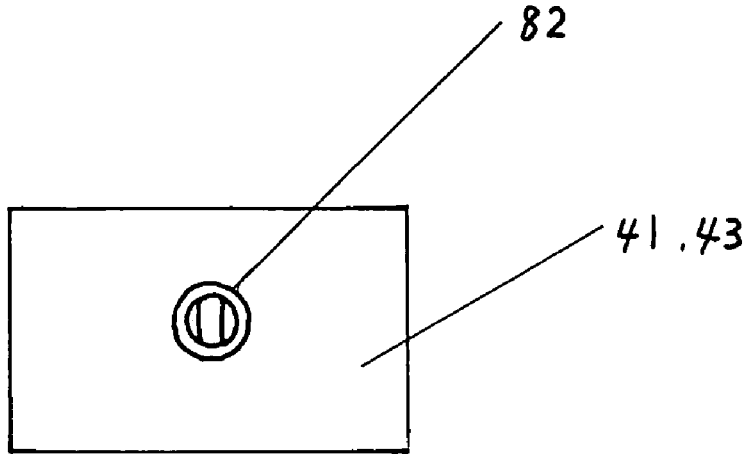
FIG. 30*a* is a view illustrating a female of a Velcro fastener and a male snap fastener as parts of the button fastener.
Figure 30B:
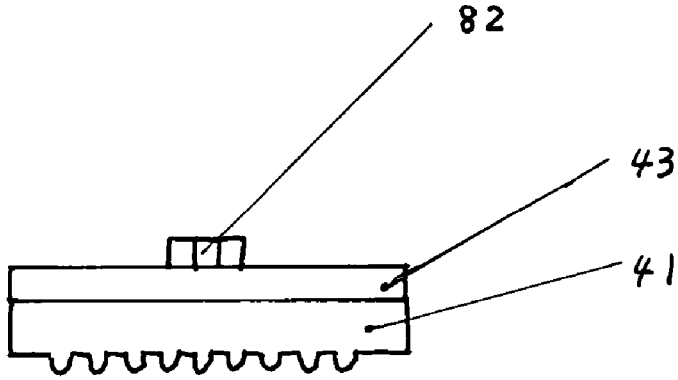
FIG. 30*b* is a bottom view of FIG. 30*a.*

The button with snap fastener 70 can be used to function as a tie clip. Thus, the fifth button or the like of a shirt 20 is replaced with the button with snap fastener 70 and its mating female snap fastener 82 is provided on the wider flap section 11 of a necktie as shown in FIGS. 29*a*, 29*b*, 30*a* and 30*b*. However, it is difficult to fit the male and female fasteners exactly. Accordingly, Velcro tapes 41 and 42 that act as male and female are used as part of the present invention to allow the position of the female snap fastener 82 on the wider flap section 11 to be varied at will according to the position of the button with snap fastener 70. Thus, in FIGS. 29*a* and 29*b* the female Velcro tape 42 is attached to the narrower flap section's stopper 14 at, e.g., the center thereof, on the wider flap section 11 by bonding or stitching. And, its mating male Velcro tape 41 as shown in FIGS. 30*a* and 30*b* is attached to cloth 43 (having the female snap fastener 82, e.g., stitched thereto), by stitching or bonding. The male and female snap fasteners can be fitted exactly in position upon changing the amount of overlap of the male and female Velcro tapes 41 and 42. Snapping these male and female snap fasteners prevents the necktie from dangling and buckling as a tie clip and is fashionable and smart.

Also, making the strength of fastening by the Velcro tapes greater than that by the snap fasteners causes the necktie to come off the shirt by the snap fasteners. This is very advantageous in, e.g., in fastening a seat belt on a car, i.e., by removing the necktie from the shirt before fastening the seatbelt.

Figure 25B:
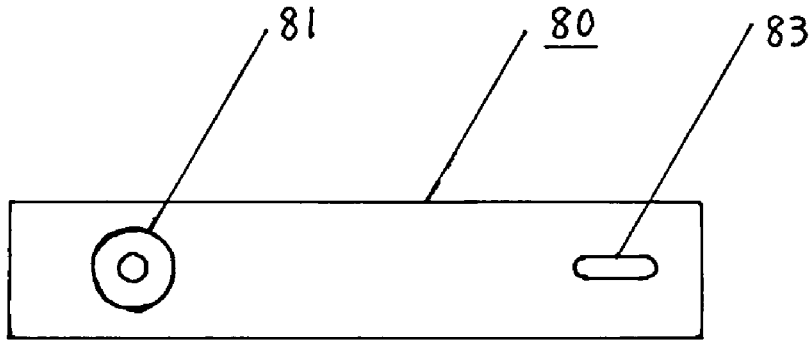
FIG. 25*b* is a front view of the band piece with the snap pair.

Next, as a novel necktie a band piece having fastening sections at its both ends as shown in FIGS. 25*a* and 25*b* is made the necktie. The band piece is made of a material such as a rubber product or cloth and can be used with its surface colored or marked in any of a variety of ways. Having neither "wider flap section" 11 nor "narrower flap section", it is convenient in carrying goods with one's breast.

Also, while a bow tie or ribbon necktie is ordinarily used with a string wound around the neck, using the fastener means therefor makes oppression around the neck area nil.

Finally, a shirt is required which is suited with a necktie of the present invention. It is required that the shirt be provided at the collar with fastening sections and with a button with snap fastener.

Industrial Applicability

A necktie of the present invention made in the manner described in the foregoing can be used by one regardless of sex and age as a novel necktie that substitutes for a conventional necktie and for a simplified necktie of detachable type.

Also, a necktie of the present invention, which the fastener means is used only to cause to be suspended below the neck of a shirt, can make oppression around the neck area nil, and its fitting and detaching can be accomplished in a several seconds. Also, the necktie can be washed easily, and excels in appearance with a pattern continuing in its knot and wider flap sections. It is comfortable if fitted on a hot summer day and has an energy saving effect, too. And, the neckties will certainly be liked by haters of neckties.

Becoming a "necktie revolution" that breaks through the fixed idea that the necktie is wound around the neck and is worrisome, a necktie according to the present invention is high in practical utility.

What is claimed is:

1. A necktie characterized in that an uncut, unseparated and undrilled tie body (10) comprising a wider and a narrower elongate flap section (11, 12) is formed between the wider and narrower elongate flap sections (11, 12) with a knot or knot like section (17) in which a shaping element (28, 29) configured essentially in the form of an inverted triangular pyramid is inserted, the knot or knot like section (17) being adapted to be attached to the collar of a shirt (20) by a fastening means (30) to cause the wider and narrower elongate flap portions (11, 12) depending in layers from the knot or knot like section (17) to be suspended from the collar of the shirt (20), the fastening means being in the form of an elastic or stretchable band piece (30) having fastening sections (31, 31) at both ends thereof adapted to engage with fastening sections (22, 22) which are provided on the collar of said shirt (20), said band piece (30) passing through said knot or knot like section to cause said tie body (10) to be suspended from said collar of the shirt (20) of which a first button is left unfastened.

2. A necktie characterized in that an uncut, unseparated and undrilled tie body (10) comprising a wider and a narrower elongate flap section (11, 12) is formed between the wider and narrower elongate flap sections (11, 12) with a knot or knot like section (17) in which a shaping element (28, 29) configured essentially in the form of an inverted triangular pyramid is inserted, the knot or knot like section (17) being adapted to be attached to the collar of a shirt (20) by a fastening means (30) to cause the two elongate flap portions (11, 12) depending in layers from the knot or knot like section (17) to be suspended from the collar of the shirt (20), the fastening means being in the form of an elastic or stretchable band piece (30) having fastening sections (31, 31) at both ends thereof adapted to engage with fastening sections (22, 22) which are provided on the collar of said shirt (20), wherein said knot section is formed as a knot like section by:

folding the tie body (10) along a crease (13) between the wider and narrower elongate flap section (11, 12) thereof so that the rear surfaces of said sections (11, 12) face with each other, causing edges of said narrower elongate flap section (12) in the vicinity of the crease (13) to be folded about a longitudinal center line so as to form a reduction of area (15) in said narrower elongate flap section (12), and after the tie body (10 ) is folded along said crease (13), folding edges of said wider elongate flap section (11) so as to wrap said reduction of area (15) up with said wider elongate flap section (11) in the vicinity of said crease (13) and securing the folded edges of said wider flap portion (11) together so as to form a constriction (19) in said wider elongate flap section (11), thereby forming said knot like section (17) between said constriction (19) and said crease (13), said band piece passing through said knot or knot like section to cause said tie body (10) to be suspended.

3. A necktie characterized in that an uncut, unseparated and undrilled tie body (10) comprising a wider and a narrower elongate flap section (11, 12) is formed between the wider and narrower elongate flap sections (11, 12) with a knot or knot like section (17) in which a shaping element (28, 29) configured essentially in the form of an inverted triangular pyramid is inserted, the knot or knot like section (17) being adapted to be attached to the collar of a shirt (20) by a fastening means (30) to cause the two elongate flap portions (11, 12) depending in layers from the knot or knot like section (17) to be suspended from the collar of the shirt (20), the fastening means being in the form of an elastic or stretchable band piece (30) having fastening sections (31, 31) at both ends thereof adapted to engage with fastening sections (22, 22) which are provided on the collar of said shirt (20), wherein the tie body (10) is tied around said shaping element (28, 29) and said fastening means (30) to form said knot or knot like section (17), said band piece (30) passing through said knot or knot like section (17) to cause said tie body to be suspended from said collar of the shirt (20) of which a first button is left unfastened.

4. A necktie characterized in that an uncut, unseparated and undrilled tie body (10) comprising a wider and a narrower elongate flap section (11, 12) is formed between the wider and narrower elongate flap sections (11, 12) with a knot or knot like section (17) in which a shaping element (28, 29) configured essentially in the form of an inverted triangular pyramid is inserted, the knot or knot like section (17) being adapted to be attached to the collar of a shirt (20) by a fastening means (30) to cause the two elongate flap portions (11, 12) depending in layers from the knot or knot like section (17) to be suspended from the collar of the shirt (20), the fastening means being in the form of an elastic or stretchable band piece (30) having fastening sections (31, 31) at both ends thereof adapted to engage with fastening sections (22, 22) which are provided on the collar of said shirt (20), wherein said knot section is formed as a knot like section by:

folding the tie body (10) along a crease (13) between the wider and narrower elongate flap section (11, 12) thereof so that the rear surfaces of said sections (11, 12) face with each other, causing edges of said narrower elongate flap section (12) in the vicinity of the crease (13) to be folded about a longitudinal center line so as to form a reduction of area (15) in said narrower elongate flap section (12), and after the tie body (10 ) is folded along said crease (13), folding edges of said wider elongate flap section (11) so as to wrap said reduction of area (15) up with said wider elongate flap section (11) in the vicinity of said crease (13) and securing the folded edges of said wider flap portion (11) together so as to form a constriction (19) in said wider elongate flap section (11), thereby forming said knot like section (17) between said constriction (19) and said crease (13), wherein said knot like section (17) and said wider flap portion (11) of the tie body (10) are continuous with each other and have a pattern, a design or ornamentation applied thereto on their surfaces (FIG. 14), said band piece passing through said knot or knot like section to cause said tie body to be suspended.

5. A necktie as set forth in claim 1, 2, 3 or 4, characterized in that at least one of said fastening sections (31, 31) on the band piece comprises a male and a female snap fastener (81, 82) which are secured to said band piece (80) coaxially on its front and rear surfaces.

6. A necktie as set forth in claim 1, 2, 3 or 4, characterized in that a dimple (60) is formed on a surface of said wider flap section (11) of the tie body (10) by picking up a portion (61) thereof from its rear surface.

7. A necktie as set forth in claim 1, 2, 3 or 4, characterized in that a button fastener (18) for engaging with a shirt button on said shirt other than its first button is provided on a rear surface of said wider flap section (11) or a front or rear surface of said narrower flap section (12) of the tie body (10) at a position that can adjustably be varied corresponding to the position of said shirt button.

8. A necktie as set forth in claim 7, characterized in that said shirt button for engagement by said button fastener (18) is a button with a snap fastener (70) having functions of both the button and the snap fastener.

9. A necktie as set forth in claim 1, 2, 3 or 4, characterized in that said band piece (30) has another fastening section (32*a*) which is adapted to engage with a further fastening section (32*b*) that is provided in said knot like section to cause said tie body to be suspended.

* * * * *